US010457541B2

(12) United States Patent
Benetti

(10) Patent No.: US 10,457,541 B2
(45) Date of Patent: Oct. 29, 2019

(54) UNDER-SADDLE AND MANUFACTURING METHOD THEREOF

(71) Applicant: AMAHORSE TRADING S.r.l., Perugia (IT)

(72) Inventor: Mauro Benetti, Brescia (IT)

(73) Assignee: AMAHORSE TRADING S.r.l., San Giustino, Perugia (IT)

( * ) Notice: Subject to any disclaimer, the term of this patent is extended or adjusted under 35 U.S.C. 154(b) by 147 days.

(21) Appl. No.: 15/115,054

(22) PCT Filed: Jan. 26, 2015

(86) PCT No.: PCT/IB2015/050565
§ 371 (c)(1),
(2) Date: Jul. 28, 2016

(87) PCT Pub. No.: WO2015/114502
PCT Pub. Date: Aug. 6, 2015

(65) Prior Publication Data

US 2016/0340172 A1 Nov. 24, 2016

(30) Foreign Application Priority Data

Jan. 31, 2014 (IT) ..... BS2014A0030

(51) Int. Cl.
*B68C 1/12* (2006.01)

(52) U.S. Cl.
CPC ..... *B68C 1/12* (2013.01)

(58) Field of Classification Search
CPC ..... B68C 1/12; B68C 1/126
(Continued)

(56) References Cited

U.S. PATENT DOCUMENTS 4,140,116 A * 2/1979 Hampicke ..... A61D 9/00 54/82
4,470,411 A * 9/1984 Hoyt, Jr. ..... A61D 9/00 54/82

(Continued)

FOREIGN PATENT DOCUMENTS

DE 26 13 776 A1 10/1997
DE 202012103575 U1 * 10/2012 ..... B68C 1/12

(Continued)

OTHER PUBLICATIONS

English-language translation of DE 2613776 (Year: 1977).*

(Continued)

*Primary Examiner* — Lisa L Tsang
(74) *Attorney, Agent, or Firm* — Thomas Horstemeyer, LLP

(57) ABSTRACT

Under-saddle (1) comprising a flexible base (2) which defines a pair of base surfaces (4, 4') separated through the relative thickness (6), and a plurality of separation elements (8, 8', 10, 10') which extend from at least one (4, 4') of said surfaces to distance the flexible base (2) from an opposite abutment surface (12, 12') in contact with said elements. The separation elements 8, 8', 10, 10' are reciprocally distributed in such a way that at least a pair of them delimits with the base surface (4; 4') and with the abutment surface (12, 12') an aeration chamber or duct (14) open on at least one side. The present invention further relates to a manufacturing method of an under-saddle.

9 Claims, 2 Drawing Sheets

(58) Field of Classification Search
USPC ..... 54/41.1, 44.5, 65, 66
See application file for complete search history.

(56) References Cited

U.S. PATENT DOCUMENTS

| | | | | |
|---|---|---|---|---|
| 5,802,823 | A | 9/1998 | Woods | |
| 6,415,583 | B1 * | 7/2002 | Landi | B68C 1/12 54/44.7 |
| 6,421,989 | B1 * | 7/2002 | Leson | B68C 1/12 54/66 |
| 2008/0184678 | A1 * | 8/2008 | Chang | A01K 13/006 54/65 |
| 2015/0121820 | A1 * | 5/2015 | Mahajan | B68C 1/12 54/66 |
| 2015/0166325 | A1 * | 6/2015 | Mattes | B68C 1/12 54/44.5 |

FOREIGN PATENT DOCUMENTS

| | | | | |
|---|---|---|---|---|
| GB | 189045 A | * | 11/1922 | B68C 1/12 |
| GB | 2090512 A | * | 7/1982 | B68C 1/12 |
| GB | 2 440 709 A | | 2/2008 | |

OTHER PUBLICATIONS

International Search Report for PCT/IB2015/050565 dated Apr. 22, 2015.
Translation of the Abstract for DE 26 13 776 published Oct. 13, 1977.
Translation of the Abstract for GB 2 440 709 published Feb. 13, 2008.

* cited by examiner

UNDER-SADDLE AND MANUFACTURING METHOD THEREOF

CROSS-REFERENCE TO RELATED APPLICATION

This application is the 35 U.S.C. § 371 national stage application of PCT Application No. PCT/IB2015/050565, filed Jan. 26, 2015, where the PCT claims priority to and the benefit of, IT Patent Application No. BS2014A000030, filed Jan. 31, 2014, both of which are herein incorporated by reference in their entirety.

The present invention relates to a manufacturing method of an under-saddle, and an under-saddle for example made using said method. In particular, said under-saddle is suitable for the mounting of animals by humans, preferably an under-saddle for horse-riding.

It is known of to interpose mats between the horse's back and a saddle for horse-riding. The main purpose of such use is to avoid accidental slipping of the saddle from the horse's back, in which case a situation of potential danger to the rider or to the animal could arise.

The materials traditionally used for the aforesaid mats are textiles or synthetic laminates, and are subject to relatively deteriorating conditions, by virtue of the body temperature, surface abrasion and sweat of the animal.

The impregnation with humidity of the above materials and the frictional forces acting on them progressively reduce their performance, so that the risk of accidents tends to increase with the passage of time or with the intensive use of the saddle.

The present invention lies in the above context, proposing to provide an under-saddle for horse-riding able to drain away the sweat of the animal outside the space below the harness, and further designed to increase the friction coefficient between the saddle and the animal.

Such objective is achieved by an under-saddle according to claim 1, and by means of a manufacturing method of an under-saddle according to claim 10. The dependent claims describe advantageous or preferred embodiments.

The object of the present invention will now be described in detail, with the help of the appended drawings, wherein.

Figure 1:
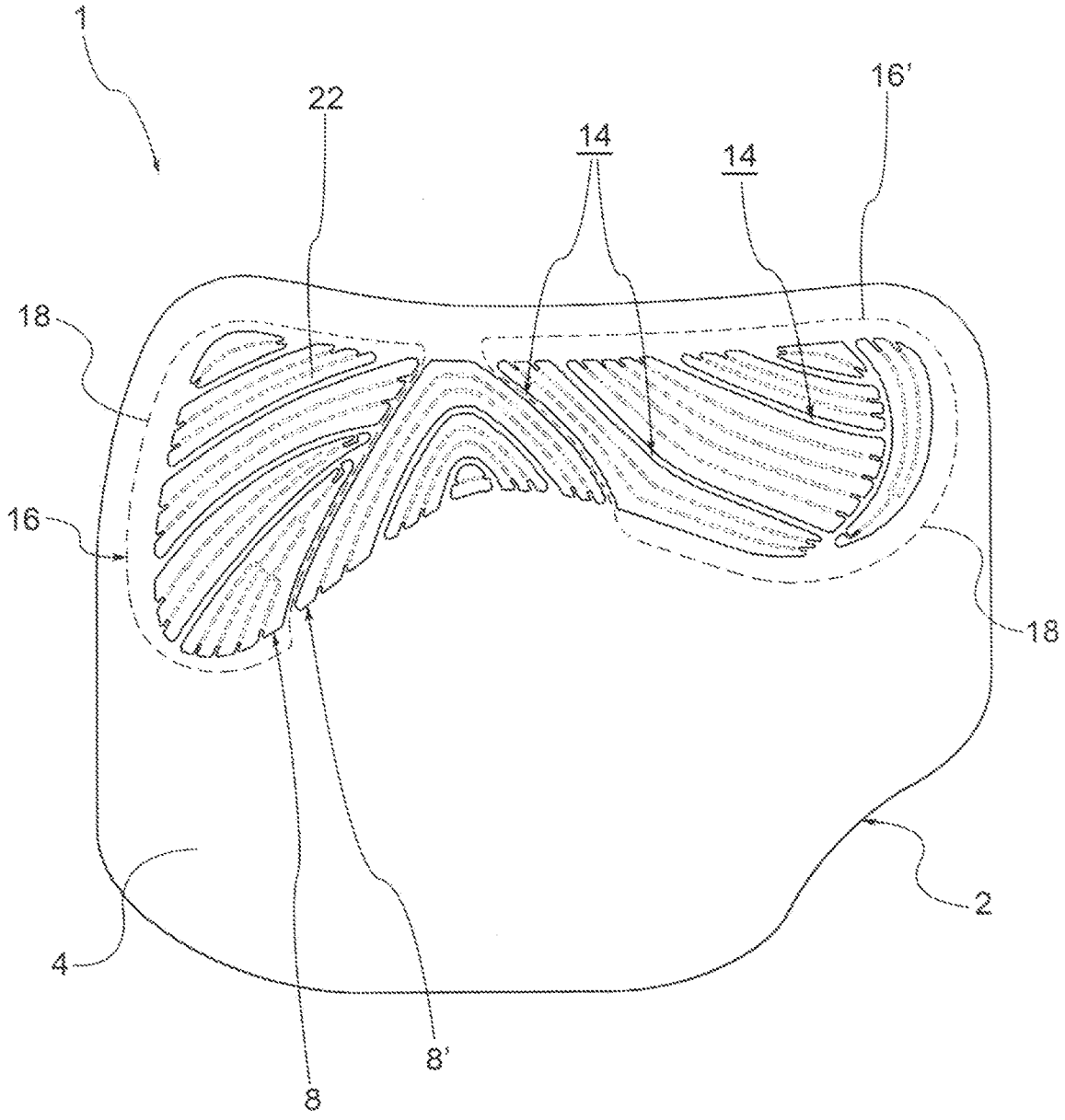
FIG. 1 shows a plan view of half of the under-saddle of the present invention, according to a possible variant, the other half being superposed rearwards and thus hidden from view.

With reference to the aforementioned drawings, reference numeral 1 globally denotes an under-saddle.

Although the preferred use of this under-saddle provides for the placing thereof between the animal and the saddle, an alternative mode of using it could envisage placing it on a top surface of the seat of the saddle, so as to be interposed between the saddle and the rider. In said latter case, the benefits in terms of preventing slipping and in comfort would be the same.

Said under-saddle comprises a flexible base 2 which defines a pair of base surfaces 4, 4' separated through the relative thickness 6.

According to possible variants, the flexible base 2 comprises at least one layer of cloth or fabric, polymer and/or leather.

According to a preferred variant, the thickness 6 of the flexible base 2 is crossed by at least one through hole 20.

This way, the base areas 4, 4' communicate with each other through the base. Preferably, a plurality of such holes 20 is provided.

The under-saddle 1 further comprises a plurality of separation elements 8, 8', 10, 10', which extend in at least one of the base surfaces (4 or 4', but preferably both) to distance the flexible base 2 from an opposite abutment surface 12, 12', in contact with said elements.

According to the method of use discussed above, the abutment surface 12, 12' could be identified by the back of an animal/horse, by a saddle for riding (under or upper) and/or by a rider sitting on a saddle.

Consequently, a free end surface 24 of the separation elements 8, 8', 10, 10' distances the animal/horse, the saddle or the rider from the flexible base 2.

It follows that the opposite base surface 4' may lie in contact (direct or indirect) with the animal/horse, the saddle or the rider, or, if bearing in turn such elements, will be distanced by an opposite abutment surface 12'.

Advantageously, one or more separation elements 8, 8', 10, 10' are at least partly made from a polymer, preferably a visco-elastic material.

Preferably, the separation element 8, 8', 10, 10' is at least partially made of a polymer or in a visco-elastic material (micro-) injected on or in the flexible base 2.

According to one variant, one or more separation elements 8, 8', 10, 10' are partially flexible.

Figure 3:
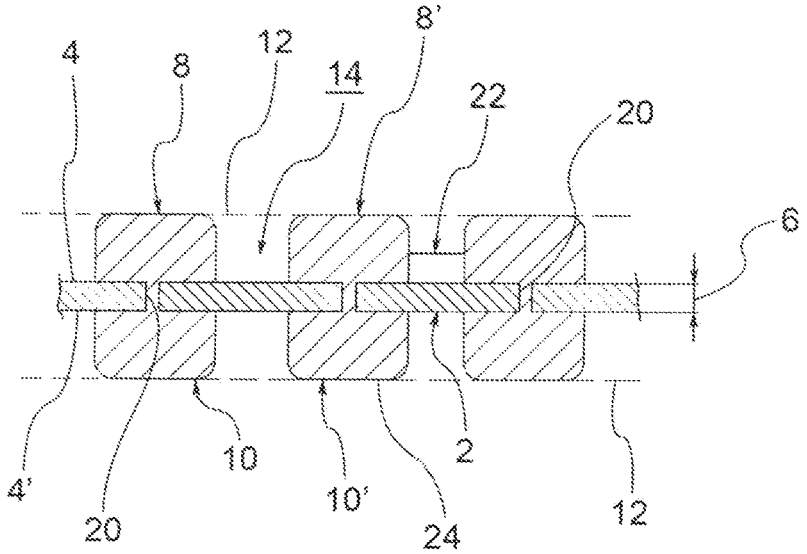
FIG. 3 shows a schematic cross-section view of an under-saddle during its use.

According to the schematic diagram shown in FIG. 3, each base surface 4, 4' comprises at least one separation element 8, 8', 10, 10' where such elements 8, 8', 10, 10' are at least partially aligned or corresponding with each other.

According to one advantageous embodiment, at least one element 8, 8' of a first surface of the base 4 is mechanically connected to an element 10, 10' of a second surface of the base 4' through the thickness 6 of the flexible base 2, in particular through one or more through holes 20 such as those described previously.

It follows that in addition to the normal adhesion that can be expected between the separation elements and the flexible base, this variant also provides for a real mechanical anchoring of each element in the thickness of the base.

The separation elements 8, 8', 10, 10' are reciprocally distributed in such a way that at least a pair of them delimits with the base surface and with the abutment surface 12, 12' an aeration chamber or duct 14 open on at least one side.

As a result, innovatively, the presence of the separation elements makes it possible to create a space between the flexible base and the abutment surface, so as to aerate said space.

According to an advantageous variant, the aeration duct 14 is directed so as to make any humidity present between the aforesaid surfaces 4, 12; 4', 12' drain off, for example by gravity. This moisture could specifically derive from the sweat of the animal, or the rider, or even from bad weather conditions.

With reference for example to the embodiment in FIG. 1, it may be noted that when the under-saddle 1 is correctly positioned, each duct 14 terminates directly or indirectly downwards, so as to avoid the accumulation of liquid between the surfaces 4, 12, 4', 12', and thus avoid the reduction of friction of the flexible base with the abutment surface, complained of in the prior art.

Advantageously, the separation elements 8, 8', 10, 10' are grouped together in one or more groupings 16, 16' circumscribed by a perimeter 18, where at least one aeration chamber or duct 14 ends at said perimeter.

In other words, it is preferable for the aeration chamber/duct or plurality thereof to face the perimeter 18, since this way it is possible to reduce the amount of moisture accumulated inside the chamber/duct.

Preferably, the separation elements 8, 8', 10, 10' or the groupings 16, 16' (where provided for) are distributed on the base surface 4, 4' with a surface density varying in relation to the weight weighing upon them.

In other words, since the compression of the elements tends to close the aeration chamber/ducts, especially in the variant in which said elements are flexible, by selecting a suitable surface density it is possible to limit said phenomenon of occlusion.

According to an advantageous variant, at least one aeration chamber or duct 14 is crossed, for example in a transversal direction to its main extension, by at least one connection bridge 22 which joins adjacent separation elements 8, 8', 10, 10' and which limits possible bottlenecks of the chamber or duct 14.

According to one variant, a plurality of connection bridges 22 are provided which extend along a respective separation element.

With reference for example to the embodiment in FIG. 3, the connection bridge 22 or plurality thereof extends from the base surface 4.

Moreover, according to a further embodiment, the connection bridge 22 or plurality thereof extends from the surface of the base 4 as far as a height below the free end surface 24 of the separation elements 8, 8', 10, 10'.

Figure 2:
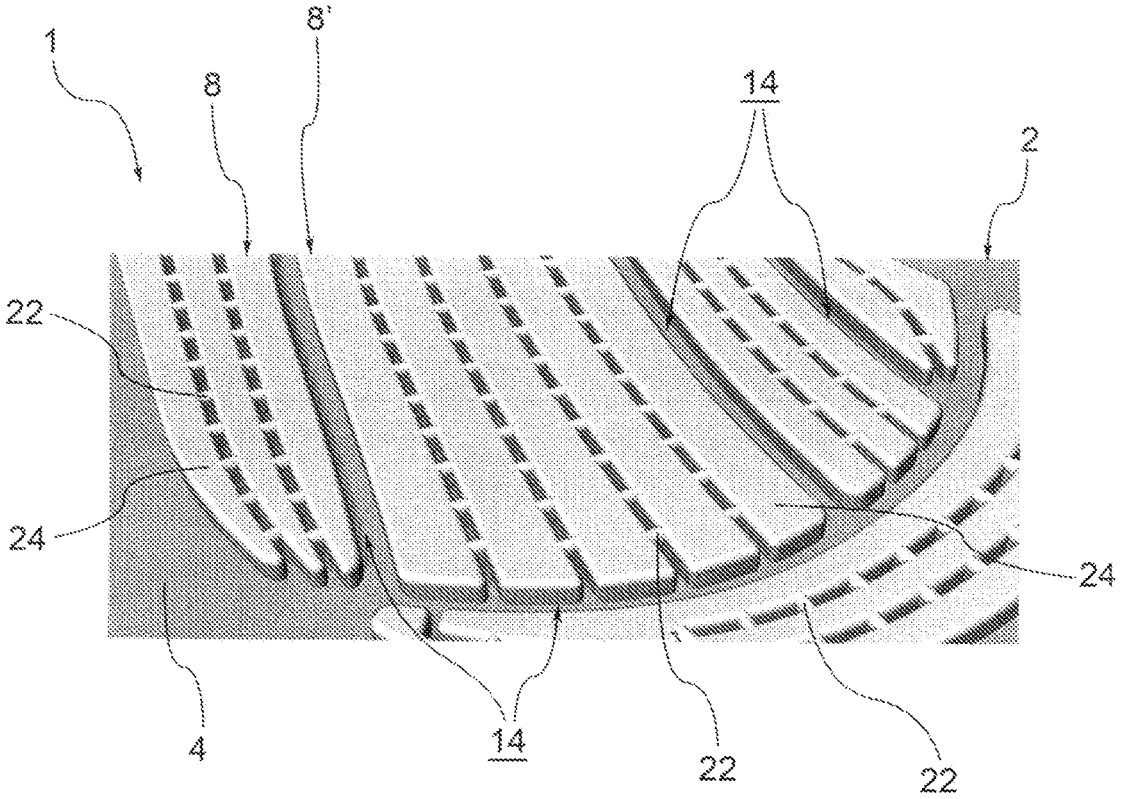
FIG. 2 shows a perspective view of a detail of the under-saddle in FIG. 1.

The variant in FIG. 2 shows, however, that the connection bridge 22 and the free end surface 24 reach substantially the same height.

The present invention also relates to a method for manufacturing an under-saddle 1, preferably according to any one of the embodiments discussed above.

It follows that, even where explicitly indicated, preferred or advantageous embodiments of said method provide for all the processing stages inferred from the structural characteristics indicated above.

Such method comprises, for example, in sequence, the steps of:

providing a flexible base 2 which defines a pair of base surfaces 4, 4' separated through the relative thickness 6;

closing at least a part of the base 2 in a mould;

(micro-)injecting at least one polymer onto or into the flexible base 2 to make a plurality of separation elements 8, 8', 10, 10' which extend from at least one of the base surfaces, where the separation elements are reciprocally distributed so that at least a pair of them delimit with said base surface 4, 4' part of an aeration chamber or duct 14 open on at least one side.

According to an embodiment of particular advantage, said method comprises a step of making at least one separation element 8, 10, 8', 10' for each base surface 4, 4'.

Preferably, the step of (micro-) injecting comprises a step of transit of a polymer or of a visco-elastic material through at least one through hole 20 through the thickness 6 of the flexible base 2.

Innovatively, the under-saddle of the present invention is configured to permit the transpiration of the rider or of the animal despite the covering action of the flexible base.

Advantageously, the method of the present invention makes it possible to make an extremely high-performance under-saddle inexpensively.

Advantageously, the components described above are firmly connected to the under-saddle of the present invention, which presents appropriate anti-slip characteristics, a fact which dramatically reduces the risk of accidents.

Advantageously, the under-saddle of the present invention is designed to reduce or even prevent the occlusion of the aeration chambers/ducts.

Advantageously, the separation elements described above are anchored in the thickness of the flexible base, so that their accidental detachment is substantially excluded.

Advantageously, the use of a polymeric or visco-elastic material gives the present under-saddle suitable surface adhesion characteristics.

Advantageously, the under-saddle of the present invention has appropriate cushioning properties, making riding more comfortable.

A person skilled in the art may make variations to the embodiments of the under-saddle and method described above so as to satisfy specific requirements, replacing elements with others functionally equivalent.

Such variants are also contained within the scope of protection as defined by the following claims.

In addition, each variant described as belonging to a possible embodiment may be realised independently of the other embodiments described.

The invention claimed is:

1. An under-saddle comprising:

a flexible base defining a pair of base surfaces, the flexible base having a relative thickness between the pair of base surfaces; and a plurality of separation elements extending from at least one of the base surfaces to distance the flexible base from an opposite abutment surface in contact with the separation elements; wherein:

a first portion of the separation elements are reciprocally distributed such that a pair of the separation elements, together with the at least one of the base surfaces and the opposite abutment surface, define an aeration chamber or duct that is open on at least one side; and a second portion of the separation elements are symmetrically distributed with respect to the flexible base and extending from each base surface and integrally connected to each other, the second portion of the separation elements defining a plurality of coupled separation elements of the separation elements, each of the coupled separation elements connected with a connection element via a through-hole made in the relative thickness of the flexible base;

wherein the separation elements are composed of a polymeric material injected or micro-injected on the flexible base through the through-holes made in the relative thickness of the flexible base, and each of the coupled separation elements are connected to each other via the connection element, the connection element filling the through-hole, each of the coupled separation elements and the connection element being integrally connected, forming a single piece.

2. The under-saddle according to claim 1, wherein the aeration chamber or duct is directed so as to make any humidity present between the base surfaces and abutment surface drain off by gravity.

3. The under-saddle according to claim 1, wherein the separation elements are grouped together in one or more groupings circumscribed by a perimeter, the aeration chamber or duct ending at the perimeter.

4. The under-saddle according to claim 1, wherein the separation elements are distributed on the base surface with a superficial density of the separation elements varying in relation to a weight weighing upon the separation elements.

5. The under-saddle according to claim 1, wherein the plurality of separation elements comprise a separation element for each of the base surfaces, the separation elements for each of the base surfaces being at least partially aligned or corresponding to each other.

6. The under-saddle according to claim 1, wherein the plurality of separation elements comprise a separation element for each base surface, wherein the pair of base surfaces comprise a first base surface and a second base surface, the separation element of the first base surface being mechanically connected to the separation element of the second base surface through the through-hole made in the relative thickness of the flexible base.

7. The under-saddle according to claim 1, wherein the separation elements are at least partially made of a viscoelastic material.

8. The under-saddle according to claim 1, wherein the aeration chamber or duct is crossed, by at least one connection bridge which joins the pair of the separation elements, the pair of the separation elements defining the aeration chamber or duct, and wherein the at least one connection bridge limits possible bottlenecks in the aeration chamber or duct.

9. The under-saddle according to claim 8, wherein the aeration chamber or duct is crossed in a transverse direction to a main extension of the aeration chamber or duct.

* * * * *